United States Patent [19]

Tromeur

[11] Patent Number: 4,490,122

[45] Date of Patent: Dec. 25, 1984

[54] PROCESS FOR MANUFACTURING AN IGNITION DEVICE FOR AN INTERNAL COMBUSTION ENGINE, AND IGNITION DEVICE OBTAINED THEREBY

[75] Inventor: Jean-Francois Tromeur, Pully, Switzerland

[73] Assignee: Espada Anstalt, Vaduz, Liechtenstein

[21] Appl. No.: 266,513

[22] Filed: May 22, 1981

[30] Foreign Application Priority Data

May 30, 1980 [CH] Switzerland ..... 4212/80

[51] Int. Cl.[3] ..... H01T 21/02; H01T 13/32; H01T 13/36

[52] U.S. Cl. ..... 445/7; 313/141; 313/143

[58] Field of Search ..... 445/7; 313/132, 141, 313/142, 138, 139, 143

[56] References Cited

U.S. PATENT DOCUMENTS 1,998,158 4/1935 Irvin et al. ..... 313/142 X
2,150,723 3/1939 Nowosielski ..... 313/142 X
2,616,407 11/1952 Thomas ..... 313/141 X
3,056,899 10/1962 Clayton ..... 313/122 X

FOREIGN PATENT DOCUMENTS 740872 11/1955 United Kingdom ..... 445/7

*Primary Examiner*—David K. Moore
*Assistant Examiner*—K. Wieder
*Attorney, Agent, or Firm*—Trexler, Bushnell & Wolters, Ltd.

[57] ABSTRACT

The present invention relates to a process for manufacturing an ignition device or connector for an internal combustion engine and the ignition device or convection obtained by such process. The ignition convector, in use, creates a plasma for igniting lean mixtures. Said device an insulator 2 containing a central electrode 3 and a metal shell 4, in which the insulator is fixed. The ground electrode of conventional spark-plugs is replaced by a circular capsule 17 welded to the shell base, after having been subjected to a hard chromizing treatment. The shell comprises an annular recess 14 provided in the thickness of its wall, and is welded to the ceramic insulator 2 by brazing.

4 Claims, 4 Drawing Figures

PROCESS FOR MANUFACTURING AN IGNITION DEVICE FOR AN INTERNAL COMBUSTION ENGINE, AND IGNITION DEVICE OBTAINED THEREBY

BACKGROUND OF THE INVENTION

The present invention relates to a processs for manufacturing a plasma ignition device for an internal combustion engine, adapted particularly for igniting poor and/or hydrogenated and/or activated mixtures by catalysts, comprising an insulating body wherein there is provided an axial central bore receiving an axial metal central electrode, and a metal base comprising an axial central bore accommodating the lower portion of said insulating body and for securely fixing the device to the engine block. It also relates to an ignition device resulting from such process.

At the present time, searchers devote their efforts to extending the useful operating range of internal combustion engines of cars having much poorer or leaner fuel mixtures, allowing an increase of engine efficiency with a reduced consumption, while decreasing the combustion temperatures and reducing thereby the emission of NO . It has been established that under a certain poor mixture, the output of the engine decreases and the proportion of misfirings increases exponentially until combustion ceases completely. It is believed that one of the reasons for such problems comes from the fact that the output is limited by the speed of the flame which slows down as the mixture becomes poorer and poorer. Efforts have been made to solve such problems, for example, by means of brazing techniques, by turbulence, and by providing multiple ignition points. However, all these conceptions require a certain degree of transformation and modification of the engines. In general, efforts have been limited by the shape of the conventional spark-plug.

The study of the ignition process as a field susceptible of improvements has led to the finding that means to ignite a poor mixture in a more reliable way could be provided by increasing the discharged energy and/or displacing the ignition core through the combustion-chamber by means of electro-magnetic forces. The first results show that such a system could be realized by the fact that a small mixture volume is ionised, and brought to a very high temperature by means of a high energy pulse discharge. The plasma volume ignited is pushed into the main combustion-chamber by self-induction forces.

This idea has been applied under a certain aspect in the HONDA CIVIC AUTOMOBILE engine, which requires a new cylinder head and a third valve in a combustion prechamber where a small volume of a rich mixture is ignited and acts as a torch or burner to ignite the poor or lean mixture in the main chamber. The disadvantage of such system is that it requires a complete transformation of the engine which must be fitted with a special cylinder-head.

OBJECTS AND SUMMARY OF THE PRESENT INVENTION

The object of the present invention is to realize an ignition device of the above-mentioned type, which requires no basic modification of the engine. On the contrary, the ignition device according to the present invention maintains, in its more general aspect, the outer shapes and dimensions of a conventional spark-plug, comprising an insulating body containing an axial central electrode, and fixed in a threaded base arranged to secure the spark-plug onto the engine block and to dissipate the heat from the insulating body.

Conventional spark-plugs exhibit a few disadvantages. All automobile engineers, as well as the spark-plug manufacturers, know and agree as to the anomalies obtained with conventional spark-plugs. Such spark-plugs are in general manufactured according to old methods, which consist in shrinking on and by milling the different components of the spark-plug, the insulating body and the base or shell. This technique causes a very high pressure on the ceramic insulator at the inner seal on the insulating tip. The seal, made of an alloy based on brass and copper, has a thickness of 0.10 mm before shrinking on and an inner diameter of 6 to 7 mm. During the shrinking on operation, this seal crushes by half down to a thickness of only 0.05 mm and a surface, after crushing or collapsing, of 15 to 18 mm . It is through that surface that the heat dissipation is effected towards the metal shell or base fixed to the cylinder head of the engine. During the shrinking on operation, the insulator is subjected to thermal and mechanical tensions which, under the effect of successive thermal shocks to the engine, may cause a break at the seal plane. This anomaly is not discernible at cold conditions when manufacturing tests are carried out. The same inconveniency also happens on the central electrode at the sealing junction thereof with the terminal inner screw.

The disadvantages due to these manufacturing processes result on one hand in a substantial loss at the stage of manufacturing conventional spark-plugs, and on the other hand in a reduced reliability since certain anomalies may be revealed only after a few hours of operation.

The object of the present invention is to eliminate the above-mentioned disadvantages, by providing an ignition device allowing realization of a plasma ignition of poor or lean mixtures without basic modifications of the engine, and by providing for techniques for manufacturing and assembling such ignition device which may be realized with the basic components of conventional spark-plugs.

To this end, the process according to the invention is characterized in that the metal central electrode is fixed to the insulating body and the insulating body is fixed to the metal shell or base by means of a ceramic-metal brazing technique. A metal capsule is manufactured having general cylindrical shape comprising a central cavity forming a precombustion-chamber and having a central circular opening on each of three angularly disposed plane faces thereof. Such capsule is subjected to a surface treatment to make it resistant to high temperatures created by the plasma and said capsule, is electrically resistance welded to the lower end of the shell or base so that the upper circular opening, provided a plane face of the capsule is concentric at the end of the insulating body. The free end of the central electrode is arranged substantially concentrically with respect to the lower circular opening of the other opposite plane face of the capsule.

The ignition device obtained by such process is characterized in that the central electrode is brazed to the insulator, in that the insulator or insulating body is brazed to the shell, and in that the earth or ground electrode is comprised of a metal capsule having a general cylindrical shape comprising a central cavity forming a combustion chamber, and a central circular opening on each of the plane faces thereof, said capsule having been previously subjected to a surface treatment making it resistant to high temperatures created by the plasma, and being fixed to the lower end of the shell so that the central electrode is arranged in the precombustion-chamber, substantially concentrically with respect to the lower opening of the plane face thereof.

THE DRAWINGS

The present invention will be better understood with reference to the following description of an examplary embodiment in connection with the annexed drawing wherein.

DETAILED DESCRIPTION OF THE ILLUSTRATED EMBODIMENT

Figure 1:
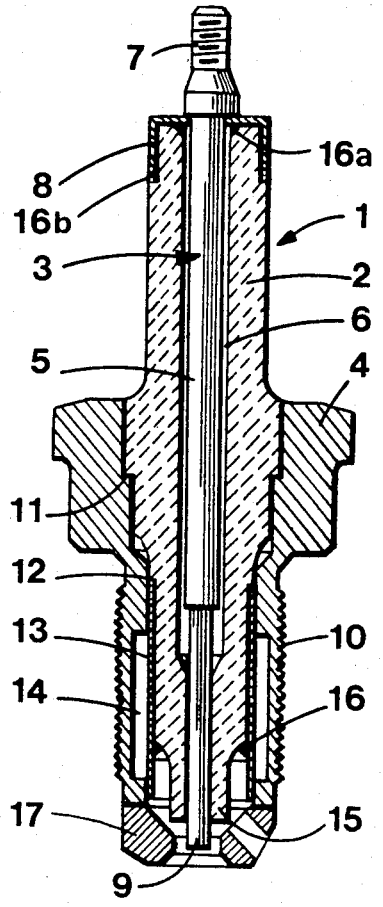
FIG. 1 represents a longitudinal cross-sectional view of a preferred form of the ignition device according to the invention.

In reference to the figures and particularly FIG. 1, the ignition device, later referred to as convector 1, is comprised substantially of an insulating body 2, an axial central electrode 3 nested inside the insulator 2, and a base or shell 4 which contains the lower portion of the insulator 2. The central electrode is comprised of a middle section 5 having the shape of a substantially cylindrical rod accommodated inside a cylindrical bore 6 of the insulator 2.

The upper end 7 is at least partially threaded on the outside to allow the screwing on of a connection nut or knob. At the junction of the end 7 and the middle section 5, there is fixed a cap 8 which covers and protects the upper tip of the insulator 2. The lower end 9 of the central electrode goes beyond the lower tip of the insulator 2 and co-operates with the ground electrode to create the spark, as in a conventional ignition spark-plug.

The central electrode is secured to the insulator by a brazing technique which will be described in greater detail hereafter, so that the brazing secures the central electrode to the insulator at its coldest point, that is to say its upper end, and also allows a perfect sealing.

As in a conventional spark-plug, the shell 4 of the convector shown comprises a threaded portion 10 intended to fix the convector to the engine block, to provide for both the mechanical connection and the thermal bridge intended to dissipate the heat from the insulator. To ensure an enhanced heat dissipation, a brazing technique is used to fix the insulator 2 into the central bore provided in the shell 4. The insulator 2 made of precision formed ceramic comprises abutting shoulders 11 and 12 which co-operate with corresponding shoulders provided in the shell 4 to ensure a precise seating of the insulator inside the shell. The brazing technique consists in first metallizing the ceramic surface by means of a powder protection of molyedenum and manganese. It then comprises the sliding on such metallized surface of a metal alloy tube 13, for example an alloy commercialized under the Dilver type, having preferably an expansion co-efficient intermediate between the co-efficient of the ceramic and the co-efficient of the steel of the shell, and introducing these pre-assembled elements in position into the shell. The tube 13 will at least partially surround the lower portion of the insulator 2 and will be arranged facing an annular recess 14, provided in the wall of the shell 4, to allow a deformation of the tube 13. To effect the brazing itself, there will be placed around the mouth 15 of the insulator 2, a brazing ring 16, for example of a copper-silver alloy, and the assembly will be subjected to a heat treatment, by passing the convector through an oven in a reduction atmosphere at a high temperature, which will cause the melting of the brazing ring and its raising by capillarity between the tube 13, the insulator 2 and the metal shell 4.

This new technique elminates mechanical shocks of the shrinking on such as it was carried out when manufactured conventional spark-plugs, and permits a brazing surface of about 330 mm , which allows a much more efficient heat dissipation and increases considerably the polythermy of the convector. This brazing operation allows simultaneous provision for the inner sealing at the central electrode and at the terminal screw. To this effect brazing rings **16*a* and 16*b* are positioned adjacent both extremities of the cap 8 adjacent the insulator 2 so that the melting brazing material flows along the central electrode 5 and the cap 8, and effects the brazing of the central electrode and the cap 8 on the insulator 2**.

This manufacturing technique allows elimination of mechanical strains and shocks due to the shrinking on techniques of conventional spark-plugs, and strains and shocks which may result in non-discernible tensions when cold, but susceptible to cause the breaking of the insulator following successive thermal shocks to which it is subjected during operation of the internal combustion engine.

The lower end of the convector comprises a capsule 17, which forms the ground electrode of said convector. This ground electrode is welded to the lower edge of the shell 4, by an electric resistance welding technique.

Figure 2:
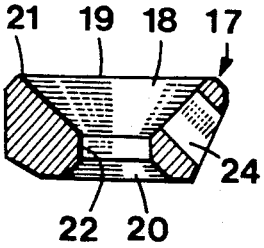
FIG. 2 represents an enlarged longitudinal cross-sectional view of the capsule forming precombustion-chamber.
Figure 3:
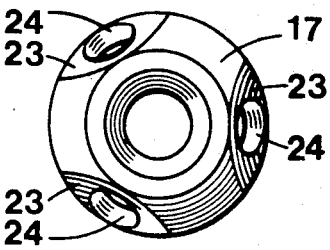
FIG. 3 represents an enlarged bottom view of the capsule represented by FIG. 2.

With reference to FIGS. 2 and 3 which show a preferred form of capsule 17, this element is preferably comprised of a piece having a general cylindrical shape produced by turning as on a lathe. The capsule is given an appropriate surface treatment, and is welded to the shell. The capsule 17 comprises a central cavity 18 communicating with two axial circular openings 19 and 20. The upper opening 19 defines, with the side wall of the cylindrical body of the capsule 17, an edge 21 intended to be fixed to the lower annular edge of the shell 4. The lower opening 20 defines an inner annular edge 22 which forms the active edge of the ground electrode of the convector. As shown more precisely on FIG. 3 the capsule 17 comprises three lands or flat surfaces through which three bores 24 open respectively. These bores communicate with the inner cavity 18.

In order to make the capsule 17 resistant to high temperatures created by the plasma, said capsule is subjected to a surface treatment which is preferably a cementation treatment with chromium and particularly a hard chromizing treatment which provides a relatively fine layer of chromium carbide of a very high hardness. To this end, it is possible to use for example the technique perfected by the French firm Heurchrome or any other known treatment obtaining a hardness and a resistance to acids and to other similar corrosive agents.

The convector described works as follows: instead of an electric spark extending between the electrodes of a conventional spark-plug to ignite the combustible mixture, the convection plug or convector, (provided with its capsule acting as a combustion prechamber) igniters the mixture previously compressed in said prechamber, by a rotary electric discharge having the shape of an ionizing iris. This generates the plasma which activates the chain reaction of the combustion in the main chamber of the motor cylinder. This results in a more intense and complete combustion of the fuel mixture, thereby resulting in an almost total utilization of the energy potential of the fuel, while reducing unburned residues and decreasing the amount of polluting gases (CO, NO , etc.), and particuarly reducing the fuel consumption.

The permanent mixing of gases through the tuyeres, formed by the side openings 24 of the convection capsule, both during intake and exhaust, together with the violence of the explosion inside the precombustion chamber, prevent the formation of carbon deposits and allow a constant self-cleaning of the insulator mouth thus substantially preventing the clogging or oiling up of the convector. This phenomenon happens particularly at low speed in urban traffic and at idling. One of the advantages of the convection capsule is that it allows use of the components of conventional spark-plugs with prominent insulating tips or mouth, wherein the convection capsule is welded to the end of the shell replacing the conventional ground electrode.

Figure 4:
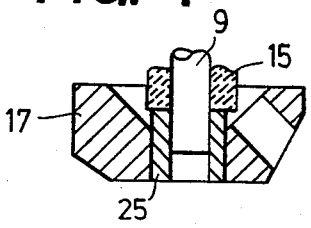
FIG. 4 comprises a fragmentary sectional view similar to the lower part of FIG. 3 showing the centering tube.

To allow a perfect centering of the capsule during the welding thereof, a small centering tube 25 (FIG. 4) of aluminum alloy is used, said tube being inserted in the opening 20 of the capsule (see FIG. 2) and on the end 9 (see FIG. 1) of the central electrode 3. The inner diameter of the centering tube corresponds substantially to the outer diameter of the end 9 of the central electrode, and its outer diameter corresponds substantially to the inner diameter of the circular opening 20 of the capsule. In fact, the thickness of the walls of the centering tube is substantially equal to the difference of diameters of the opening 20 and the end 9 of the central electrode. In this manner, the capsule is perfectly positioned during the welding operation by means of a tube made of a material which cannot be welded either to the capsule or to the central electrode.

The ignition device or convector, wherein the heat dissipation is highly enhanced, has the advantage to be polythermal. Consequently, a single convector, because of its thermal elasticity may replace advantageously a whole set of conventional spark-plugs, each of them corresponding to a small thermal range.

An ignition system, using the ignition device herein described, may be advantageously completed by a high frequency pulse current generator, in order to promote the formation of a plasma.

I claim:

1. Process for manufacturing a plasma ignition device for internal combustion engines, adapted ignition device for igniting lean mixtures, comprising an insulating ceramic body having a first axial central bore, an axial metal central electrode in said bore, a metal shell comprising a second axial central bore for housing the lower portion of said insulating body and for securely fixing the device to an engine characterized in that the metal central electrode is fixed to the insulating body and has a lower free end and the insulating body is fixed to the metal shell by means of a ceramic-metal brazing technique, in that a metal capsule is made with a general cylindrical shape comprising a central cavity forming a precombustion-chamber and having a plurality of angularly disposed plane faces with an upper circular opening, a lower circular opening, and a central circular opening in each of its plane faces, in that said capsule is subjected to a surface treatment to make it resistant to high temperatures subsequently created by a plasma, in that said capsule is positioned at the lower end of said shell and has previously been treated, and in that said capsule is welded to said base by electrical resistance welding so that the upper circular opening is concentric at the end of the insulating body, and so that the free end of the central electrode is arranged substantially concentrically with respect to the lower circular opening of the capsule, wherein the brazing of the ceramic body and the metal electrode and shell comprises the following steps: metallizing the surface of the ceramic insulator to be brazed by coating said ceramic insulator by means of a powder lay of molyedenum and manganese, lining the treated shell by means of a metal alloy tube resistant to high temperatures, the shell having been previously provided with a recess which allows the tube to deform, and brazing the central electrode to the insulating body and brazing the insulating body to the shell, by means of brazing rings located respectively between the ceramic insulator and the shell, and between the metal electrode and the ceramic insulator, by having these elements stay in an oven with passage under reducing atmosphere at a temperature sufficient to cause the fusion of the brazing ring and the spreading out of the alloy by capillarity along the metal tube, characterized in the further step before welding of precisely positioning said capsule by means of a centering device comprising a tubular piece of a non-weldable material between the capsule and the central electrode, of which the inner diameter corresponds to the outer diameter of the central electrode, and of which the outer diameter corresponds to the diameter of the lower circular opening of the capsule.

2. Process according to claim 1, characterized in that the treatment of the capsule comprises a chromium cementation.

3. Process according to claim 2, characterized in that the chromium cementation is a hard chromizing with chromium carbide.

4. Process according to claim 1, characterized in that the tubular piece is a tubular section of aluminium, of which the thickness of the wall corresponds substantially to the gap between electrodes recommended on conventional ignition sparkplugs.

* * * * *